US006508574B1

(12) United States Patent
Sara et al.

(10) Patent No.: US 6,508,574 B1
(45) Date of Patent: Jan. 21, 2003

(54) LIGHT FIXTURE

(75) Inventors: Peter C. Sara, Vista, CA (US); Steven C. Donner, San Diego, CA (US); Henry M. Avila, Palmdale, CA (US)

(73) Assignee: Allied Lighting Systems, Inc., San Diego, CA (US)

( * ) Notice: Subject to any disclaimer, the term of this patent is extended or adjusted under 35 U.S.C. 154(b) by 0 days.

(21) Appl. No.: 09/694,721

(22) Filed: Oct. 23, 2000

(51) Int. Cl.[7] ..... F21V 7/09
(52) U.S. Cl. ..... 362/297; 362/346; 362/310
(58) Field of Search ..... 362/297, 291, 362/346, 517, 518, 310, 147

(56) References Cited

U.S. PATENT DOCUMENTS

| | | | | |
|---|---|---|---|---|
| 188,700 | A | | 3/1877 | Von Otter |
| 1,100,484 | A | | 6/1914 | Inman |
| 1,350,212 | A | | 8/1920 | Davis |
| 1,421,838 | A | | 7/1922 | Schaeffer |
| 1,434,302 | A | | 10/1922 | Marcotte |
| 1,591,754 | A | | 7/1926 | Gates |
| 1,654,974 | A | | 1/1928 | Johnson |
| 2,065,164 | A | | 12/1936 | Wetzel |
| 3,456,101 | A | | 7/1969 | Rentschler et al. |
| 5,432,683 | A | | 7/1995 | Brown ..... 362/16 |
| 5,921,662 | A | | 7/1999 | Bruckner et al. ..... 362/292 |
| 6,053,625 | A | * | 4/2000 | Bowker ..... 362/147 |
| 6,168,295 | B1 | | 1/2001 | Hein et al. ..... 362/308 |
| 6,254,255 | B1 | * | 7/2001 | Entrop et al. ..... 362/223 |

* cited by examiner

*Primary Examiner*—Alan Cariaso
*Assistant Examiner*—David V. Hobden

(57) ABSTRACT

A light fixture suitable for illuminating highway signage and billboards having large surface areas. The fixture includes a curved reflector assembly, shaped generally like a cobra hood that is attached to a plate disposed in a base. The reflector assembly 38 includes a plurality of spectral segments, integrally disposed in bands and rows of the reflector assembly so that an portion of the spectral segments is disposed above the plate, an intermediate portion of the spectral segments is disposed partially above and partially below the plate, and a portion of spectral segments is disposed below the plate surface. A lamp is supported within the fixture for facilitating projecting a substantially rectangularly shaped plane of light distributed in a plurality of substantially rectangularly shaped luminance patterns onto a flat surface. In one embodiment, an induction lighting assembly is utilized in cooperation with the reflector assembly to provide uniform surface illumination at relatively low energy usage rates. Retrofit kits, for upgrading conventional light fixtures, are provided.

12 Claims, 6 Drawing Sheets

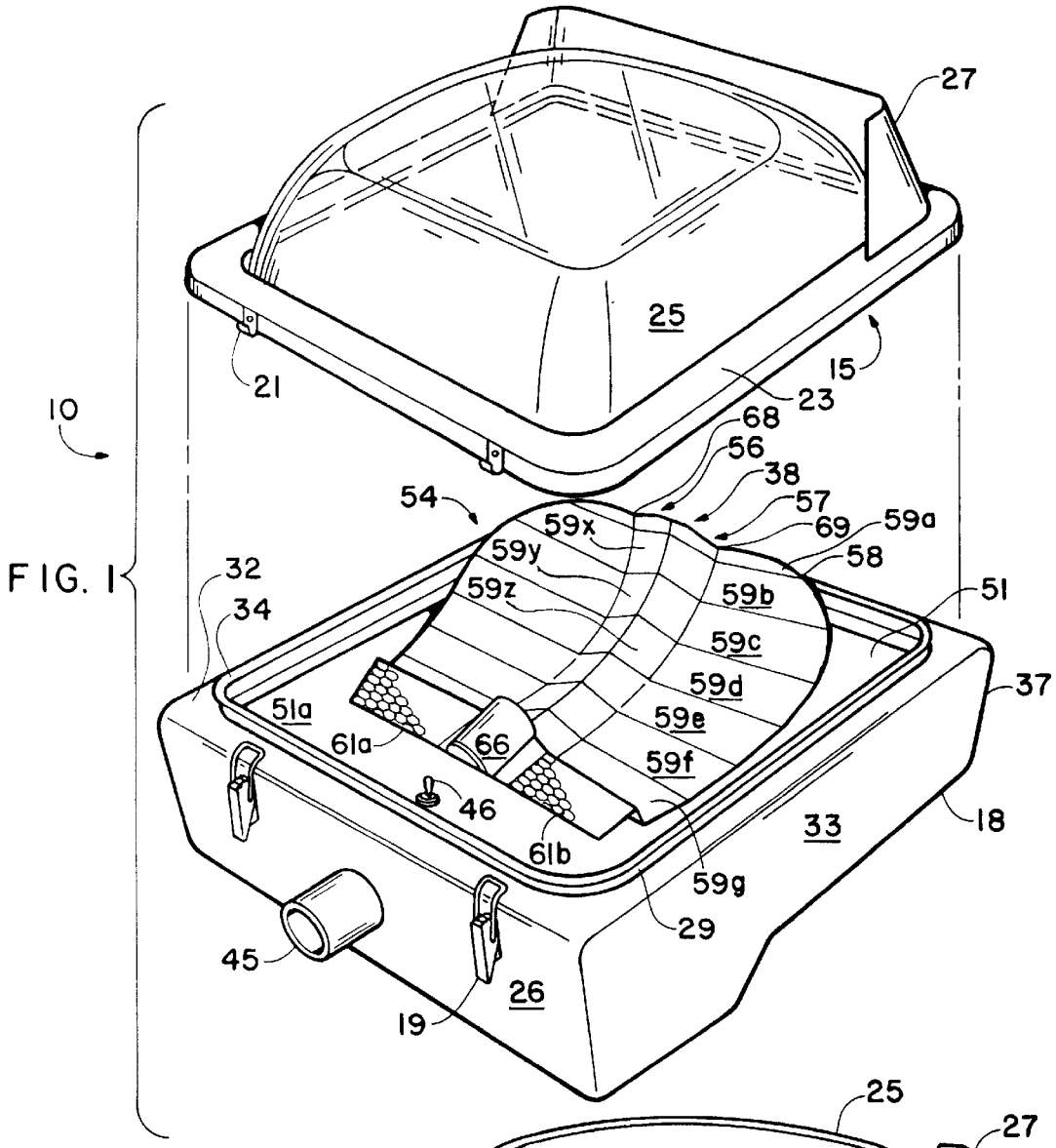
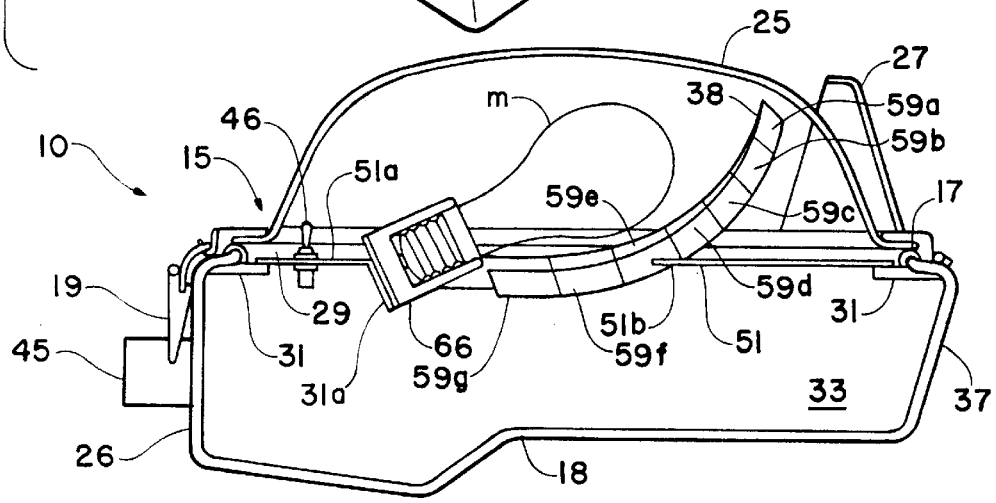
FIG. 2

LIGHT FIXTURE

FIELD OF THE INVENTION

The present invention relates generally to light fixtures and, more particularly, to light fixtures suitable for illuminating flat surfaces.

BACKGROUND OF THE INVENTION

Surface illuminating devices are well known for indoor and outdoor uses. For example, light fixtures are used in museums to illuminate paintings and other works of art. In the outdoor environment, illumination features are found in general use illuminating highway signage and advertising media such as poster boards and bulletins as discussed more fully in U.S. Pat. No. 6,168,295, incorporated herein by reference. For convenience of discussion, where the term "billboard" is used herein, it is meant to encompass both poster boards and bulletins.

While this specification sets forth the present invention as it relates to techniques of illuminating outdoor signage, it will be recognized that the present invention has application to a variety of cases wherein it is desirable to illuminate large flat surfaces.

In the case of billboards, these popular devices display graphic advertisements or public service messages and the boards are disposed so as to be seen by motorists passing them during travel. Typically, they are illuminated from below by one or a plurality of spaced light fixtures disposed along a bottom surface of the sign. An important desirable characteristic of such fixtures is that, they cooperate to provide uniform lighting to the sign so that no dark spots or shadows occur across the surface thereof. This characteristic is sometimes not found in conventional sign lighting fixtures.

Thus, it is not uncommon in some outdoor illuminating systems utilizing a plurality of conventional light fixtures, to find islands of bright illumination having shadowed areas at the periphery of the islands and between the islands of light. The result is an illuminated sign that is not esthetically attractive and which, in some respects, fails to convey an advertiser's message because of uneven illumination or shadows on the board.

The case can be more serious in highway signage wherein uneven or poor highway sign illumination can present serious safety problems, especially to the traveler unfamiliar with the terrain or during adverse weather conditions.

Thus, there is a need for a light fixture, adapted for use in illuminating flat outdoor surfaces such as highway signs and billboards that can illuminate the respective surfaces in a bright and generally uniform manner, thereby substantially reducing shadowed areas.

It will be recognized, of course, that in view of the environment in which the device is utilized, such a light fixture should have weather resistant capabilities since it will be exposed to a variety of changing and, sometimes severe, weather conditions. It should be resistant to invasion by insects and other pests and it should be easily maintained and capable of being opened quickly and easily for lamp replacement and maintenance. In addition, the light fixture should have good aerodynamic characteristics so as to withstand high winds without damage.

Further, the fixture should not contribute to "light pollution" by scattering light away from the object being illuminated. Still further, the light fixture should have a low profile so that it would not draw the eye of the observer to itself but, instead, would induce the observer to look at the surface being illuminated.

As stated above, in some cases, conventional light fixtures fail to satisfy the aforesaid criteria.

In view of the foregoing, there is a need for a light fixture having a low profile, readily accessible for repair and lamp replacement and aerodynamically shaped to help reduce wind damage. Desirably, such a light fixture would be capable of providing a broad spectrum of illumination over a flat surface so that, when used singly or in combination with similar fixtures, a large surface could be illuminated in a relatively uniform manner. Ideally, such a light fixture would be low in cost to manufacture, being constructed of readily available materials.

Desirably a light fixture having the above-described characteristics could be manufactured also in kit form for installation in existing, conventional fixtures thereby enabling low cost retrofits of such fixtures.

SUMMARY OF THE INVENTION

In accordance with the present invention, there is provided a light fixture suitable for illuminating highway signage and billboards having large surface areas. The fixture includes a curved reflector assembly, shaped generally like a cobra hood that is attached to a plate disposed in a base. The reflector assembly 38 includes a plurality of spectral segments, integrally disposed in bands and rows of the reflector assembly so that an portion of the spectral segments is disposed above the plate, an intermediate portion of the spectral segments is disposed partially above and partially below the plate, and a portion of spectral segments is disposed below the plate surface. A lamp is supported within the fixture for facilitating projecting a substantially rectangularly shaped plane of light distributed in a plurality of substantially rectangularly shaped luminance patterns onto a flat surface. In one embodiment, an induction lighting assembly is utilized in cooperation with the reflector assembly to provide uniform surface illumination at relatively low energy usage rates. A retrofit kit, for upgrading conventional light fixtures, is provided.

The present invention affords several advantages. For example, the light reflector assembly includes a plurality of highly polished, spectral segments that cooperate to distribute light over a flat surface uniformly, in an efficient and energy conserving manner. When highway signage and billboards are illuminated by the present invention, shadows and dark spots are substantially reduced and an aesthetically pleasing result is obtained.

In addition, the incorporation of an inductance lighting assembly into the light fixture results in substantially increased system life and improved performance. This is accomplished while energy costs are reduced. Further, as a result of modifying the light fixture of the present invention, retrofit kits can be utilized to modify conventional fixtures. In some cases, modification can be accomplished in the field without the necessity of removing the pre-existing fixture. Thus, older fixtures can be made more efficient at relatively low cost. Since portions of the old fixtures are conserved, additional cost savings are realized.

The light fixture of the present invention is constructed of readily obtainable materials and it has a rugged construction for use in varying weather conditions. The provision of a light shield helps to reduce unwanted light pollution and, as a result, the fixture is usable in an urban environment. In addition, the light fixture of the present invention is easy to install, mechanically simple, economical and easy to maintain and service.

Other aspects and advantages of the present invention will become apparent from the following detailed description, taken in conjunction with the accompanying drawings, illustrating by way of example the principles of the invention.

BRIEF DESCRIPTION OF DRAWINGS

FIG. 1 is a perspective view of the light fixture of the present invention showing the base and cover assembly in separated relationship;

FIG. 2 is a sectional view of the light fixture of FIG. 1, taken along the line 2—2 of FIG. 3;

DETAILED DESCRIPTION OF THE INVENTION

Figure 3:
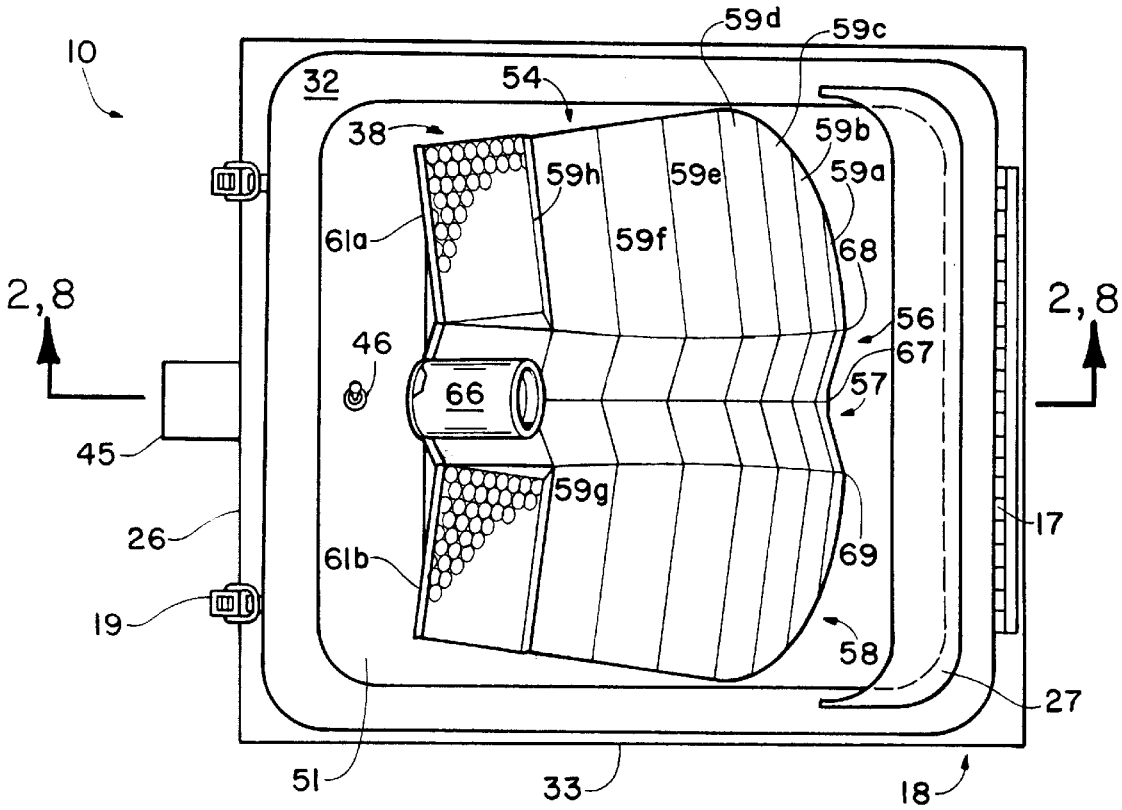
FIG. 3 a top plan view of the light fixture of FIG. 1 showing the base and reflector assembly, the cover assembly having been removed.

Referring now to the drawings, and more particularly to FIGS. 1–4 thereof, there is shown the light fixture 10 of the present invention. The fixture 10 includes a generally rectangular base 18, having a cover assembly 15 connected thereto by a hinge 17. The base 18 described and depicted herein is generally rectangular in plan view and, for convenience of description, it may be regarded as having front, back, left and right sides. It will be recognized that light fixtures having bases with other shapes, round or oval for example, are within the contemplation and scope of the present invention.

The cover assembly 15 is hingedley attached to the base by a hinge 17 and it is fixed to the base 18 by means of latches 19, which engage hooks 21 on the cover assembly 15. The cover assembly 15 includes a frame 23 that surrounds and holds a convex lens 25. A light shield 27, affixed to the frame 23, helps to prevent unwanted light scattering. The shield extends across a rear portion of the frame 23, and wraps partially along the sides of the frame 23. The light shield 27 has a height approximately equal to the height of the lens 25.

The base 18 includes a top wall 32, a right sidewall 33, a left sidewall 34, a front wall 25 and a rear wall 37. In the presently preferred embodiment of the invention, the base is constructed of stamped aluminum. A pipe 45 extends from the front wall 25 for enabling secure attachment to a support structure (not shown) and for enabling water tight and weatherproof access to the interior of the fixture 10 for provision of electrical power lines.

The base 18 includes a silicon gasket 29, disposed on the top wall 32, which serves to provide a weather tight seal when the cover assembly 15 is closed and clamped against the base 18. A switch 46, located near the front of the light fixture 10, within a perimeter formed by the gasket 29, permits power to the fixture 10 to be turned off and on during routine maintenance and lamp replacement.

The base 18 includes a generally rectangular flat sheet aluminum plate 51 that includes an upper surface 51*a* and a lower surface 51*b*. Brackets, such as the brackets 31, support the plate 51 which is fixed thereto in a conventional manner. The plate 51 includes an upper surface 51*a* and a lower surface 51*b*.

A curved reflector assembly 38 is attached to the plate 51 whereby, as described below, a portion of the reflector assembly 38 is disposed above the plate surface 51*a*, an intermediate portion of the assembly 38 is disposed partially above and partially below the plate 51, and a portion of the assembly 38 is disposed below the plate surface 51*b*. In a preferred embodiment of the invention, the reflector assembly 38 is constructed of a plurality of integrally connected spectral segments, such as the segments 59*x*, 59*y* and 59*z* (FIGS. 1 and 7). The spectral segments 59*x*, 59*y* and 59*z*, and the other unlabelled segments of the reflector assembly 38, are disposed in a series of integrally connected bands, such as the bands 59*a* through 59*g*. The bands 59*a*–59*g* are arranged generally perpendicularly to the long axis of the lamp m.

In addition to the series of connected bands, the reflector assembly 38 is divided into integrally connected rows 54, 56, 57 and 58 which are generally parallel in disposition to the axis of the lamp m. At a fold line 67 the bands 56 and 57 are disposed in a centrally located inverted V-shaped configuration while at fold lines 68 the bands are bent so as to form a pair of V-shaped configurations, flanking the fold line 67. In this manner, the fold line 67 is located a distance from the plate 51 that is greater than that of the fold lines 68 and 69.

Figure 7B:
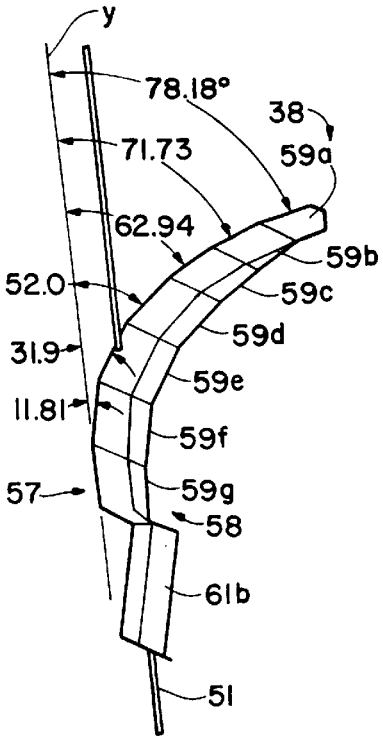
FIG. 7B is a sectional view of the reflector assembly taken along the line 7B–7B of FIG. 7.
Figure 7:
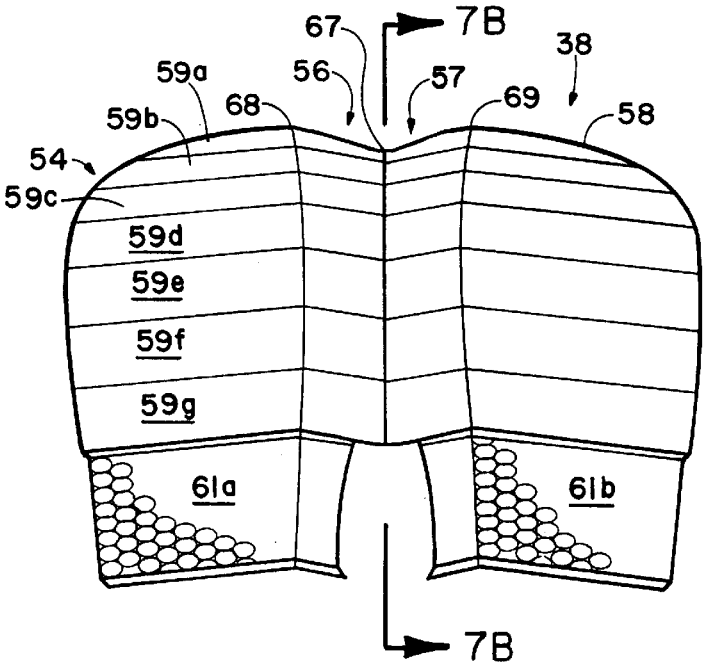
FIG. 7 is an elevational view of the reflector assembly of the light fixture shown in FIGS. 1–4.

As best shown in FIGS. 2 and 7B, in the reflector assembly 38, the integrally connected reflective bands 59*a* and 59*b* are disposed completely above the plate 51 upper surface 51*a*, the bands 59*c*, 59*d* and 59*e* are disposed in an intermediate position, being partially above the plate 51, and partially below the plate 51, while the bands 59*f* and 59*g* are disposed below the plate 51 lower surface 51*b*.

The reflector assembly 38 is fixed to the plate 51 at a supported. Opposite the support 71 is a pair of light reflecting panels 61*a* and 61*b* , each having a hammertone finish for helping diffuse reflected light. Disposed between the panels 61*a* and 61*b* is a socket bracket 66*c* that is coupled to the base 18, and to the band 59, for supporting a socket 66. In a one embodiment of the present invention, the socket 66 supports an elongated metal halide lamp so that the long axis of the lamp m forms an angle with the plate 51 of about 25 degrees.

The function of the light fixture 10, as shown in FIGS. 1–4, may now be described more fully. The reflector assembly 38 receives and supports, at a support 31*a* light generating means, such as the socket 66 and the lamp 66*a*. The reflector assembly includes a plate 51 having an upper surface 51*a* and a lower surface 51*b*.

As stated above, the reflector assembly 38 includes a plurality of groups of reflective spectral segments, wherein said plurality of reflective segments includes at least a plurality of intermediate groups of reflective segments disposed partially above the plate 51 upper surface 51*a* and partially below the plate 51 lower surface 51*b*, for facilitating projecting a substantially rectangularly shaped plane of light distributed over a flat surface in a plurality of substantially rectangularly shaped luminance patterns, each pattern being substantially coterminal with the boundaries of the surface (not shown) being illuminated. It can be seen, with reference to FIG. 7B, that the intermediate groups of segments include those in the bands 59*d* and 59*e*.

In a similar manner, the reflector assembly 38 includes a plurality of groups of reflective spectral segments that include at least a plurality of lower groups of reflective surfaces wherein each lower group of reflective surfaces is disposed below the base lower surface 51*b*, for further facilitating illuminating a surface with a plurality of substantially rectangularly shaped luminance patterns, each pattern being substantially coterminal with the boundaries of the surface (not shown) being illuminated. Reference to FIG. 7B discloses that the lower groups of spectral segments include those in the bands 59*f* and 59*g*. In addition, a plurality of upper groups of reflective surfaces disposed above the base upper surface 51*a* serves to further facilitate illuminating the surface with a plurality of substantially rectangularly shaped luminance patterns, wherein, again, each pattern is substantially coterminal with the boundaries of the surface being illuminated. The upper groups of spectral segments include those in the bands 59*a*, 59*b* and 59*c*.

In general, the plurality of substantially rectangularly shaped luminance patterns are concentrically disposed on the illuminated surface.

The plurality of the intermediate group of reflective surfaces, the plurality of the lower group of reflective surfaces and the plurality of the upper group of reflective surfaces each include at least one group of centrally disposed reflective spectral segments arranged in an inverted V-shaped configuration to help facilitate the formation of said plurality of substantially rectangularly shaped luminance patterns when light reflects therefrom. As shown best in FIGS. 1, 3 and 7, it may be said that the various groups and rows of reflective segments, integrally connected, form a cobra hood shaped reflector.

Figure 4:
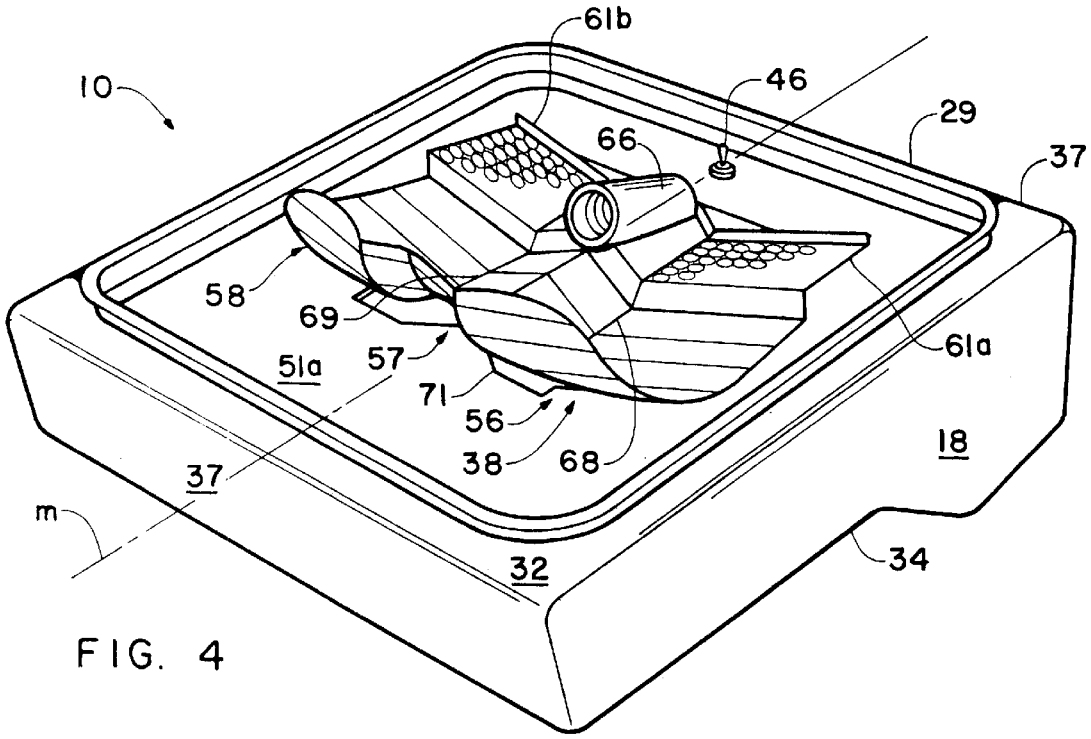
FIG. 4 is a perspective view of the light fixture of FIG. 1 showing the base and reflector assembly, the cover assembly having been removed.

As mentioned, while the base 18 is generally rectangular in shape, other shaped bases are within the scope of the present invention. Although the shape of the base might change from one embodiment to another, the light fixture 10 may be regarded as being generally symmetrical about a line m which, as shown in FIG. 4, divides, or bisects, the light fixture 10 into symmetrical halves. As the term is used herein, "bisects" means "to divide into two generally equal halves".

The light fixture 10 of the present invention, by virtue of the novel geometric arrangement of the integral, highly polished, spectral segments of the reflector assembly 38, produces a bright and uniform light over a variety of large flat surfaces, such as highway signs and billboards. For example, by reference to FIGS. 5 and 6 there are shown schematically photometric measurements on the surface of a poster board (FIG. 5), and of a paint bulletin (FIG. 6). The values are in set forth in foot candles measured illumination of the surfaces utilizing a light fixture 10 wherein the arc tube of the fixture was located at the bottom of the surface and separated therefrom a distance of five feet. The poster board measured 14 feet in width and 48 feet in length. Four 400-Watt metal halide lamps were utilized. The paint bulletin was 12 feet high and 24 feet wide and one 400-Watt metal halide lamp was utilized.

Figure 5:
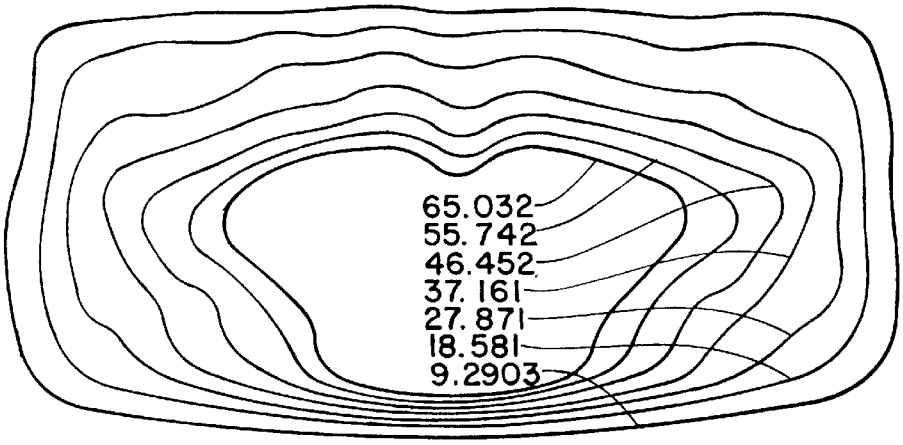
FIG. 5 is a schematic depiction of photometric readings taken at various places on a poster board illuminated by four light fixtures of the present invention.
Figure 6:
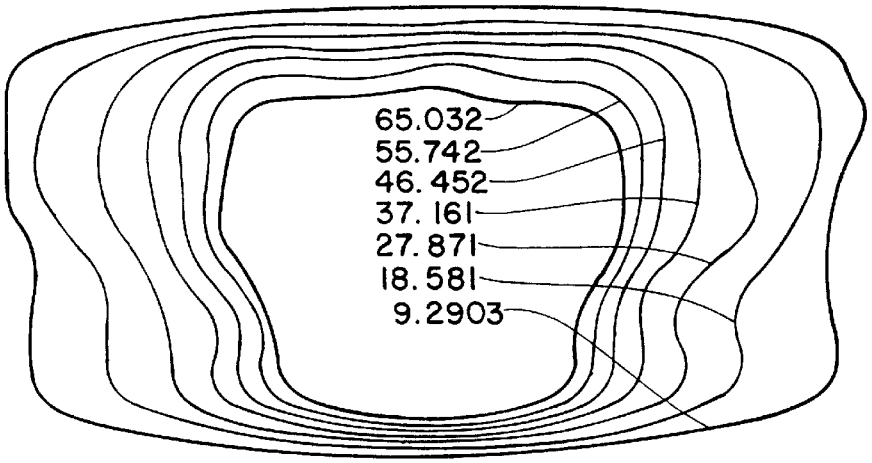
FIG. 6 is a schematic depiction of photometric readings taken at various places on a bulletin board illuminated by four light fixtures of the present invention.

It will be readily apparent that the light distribution shown in FIGS. 5 and 6 is uniformly distributed across the illuminated surface of the poster and of the paint bulletin.

Figure 8:
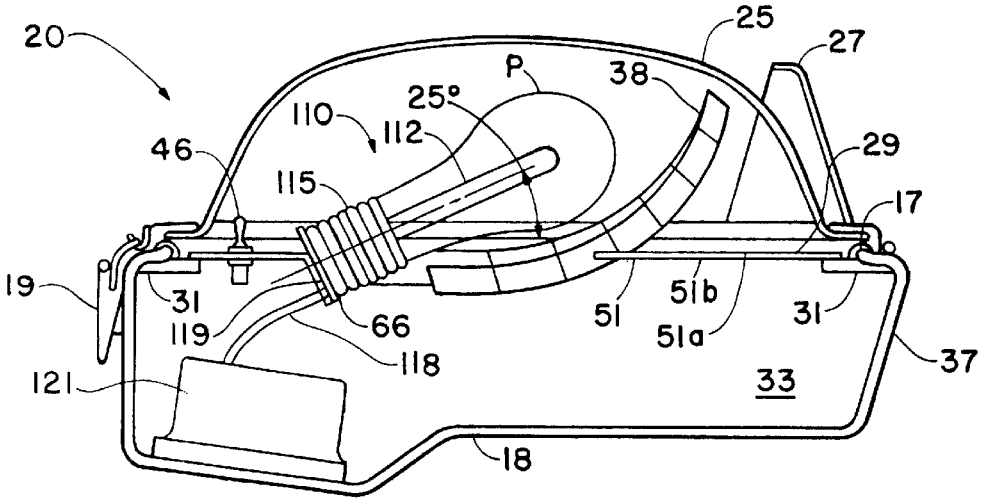
FIG. 8 a sectional view taken along the line 8—8 of FIG. 3 showing a second embodiment of the light fixture of FIG. 1 wherein an induction lighting assembly has been added.
Figure 9:
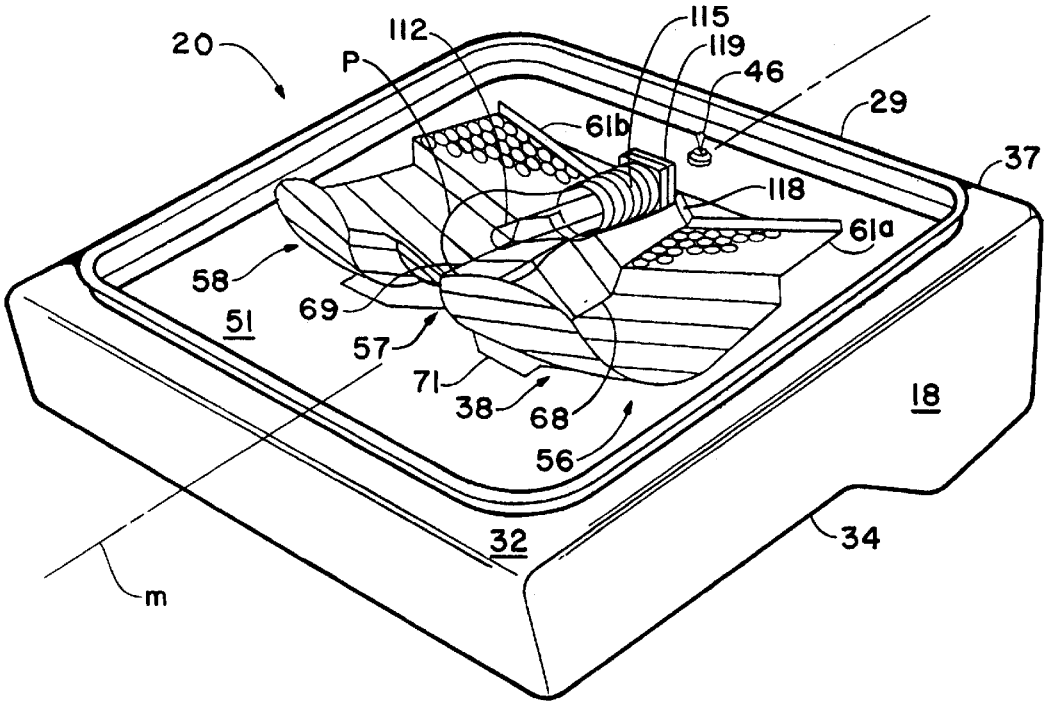
FIG. 9 is a perspective view of the light fixture shown in FIG. 8, the cover assembly having been removed.

Referring now to FIGS. 8 and 9, there is shown another light fixture 20 that is constructed according to the present invention. It will be noted that the light fixture 20 is identical in many respects to the fixture 10, having for example, a similar base 18, plate 51, reflector assembly 38, cover assembly 23 and lens 25. The light fixture 20 differs in a novel manner, however, since it includes an induction assembly 110.

Induction lamp assemblies are recognized by those skilled in the art as an unique technology that combines the basic principles of induction and gas discharge. Such systems or assemblies are noted for high luminous efficiency and excellent light quality- usually coupled with long lifetime.

The system requires no electrodes or filaments and its components function at lower operating temperatures, as compared to conventional systems. The induction lamp assembly is characterized by high system efficiency, instant start/restart capability and fast run-up time while producing light with very good color rendition, having little or no color deviation.

In operation of the induction assembly 110, light is generated by means of induction- the transmission of energy via a magnetic field-combined with a gas discharge. The assembly 110 includes a discharge vessel or lamp P, secured to a power couple 115. The lamp P contains a mixture of mercury vapor and inert gas. Discharge in the lamp P is initiated by a high electric field and maintained by means of an alternating magnetic (induction) field. Both are generated by an antenna or induction coil 112, located in the center of the discharge vessel P. The power coupler 115, electrically coupled via a coaxial cable 118 to a HF generator 121, serves to transfer energy from the HF generator 121 to the induction coil 112.

A preferred induction lighting system, suitable for use in the light fixture 20, is manufactured for OEM (original equipment manufacturers) by Philips Lighting Company, 2000 Franklin Square Drive, Somerset, N.J. 08875. The systems are available in 85, 55 and 165-Watt systems, with the 85 Watt system presently preferred. A suitable system includes a generator (product no. 24665-2), a power coupler (product No. 24944-1) and discharge vessel (product Nos. 2495-8 and 2495-6).

Figure 10:
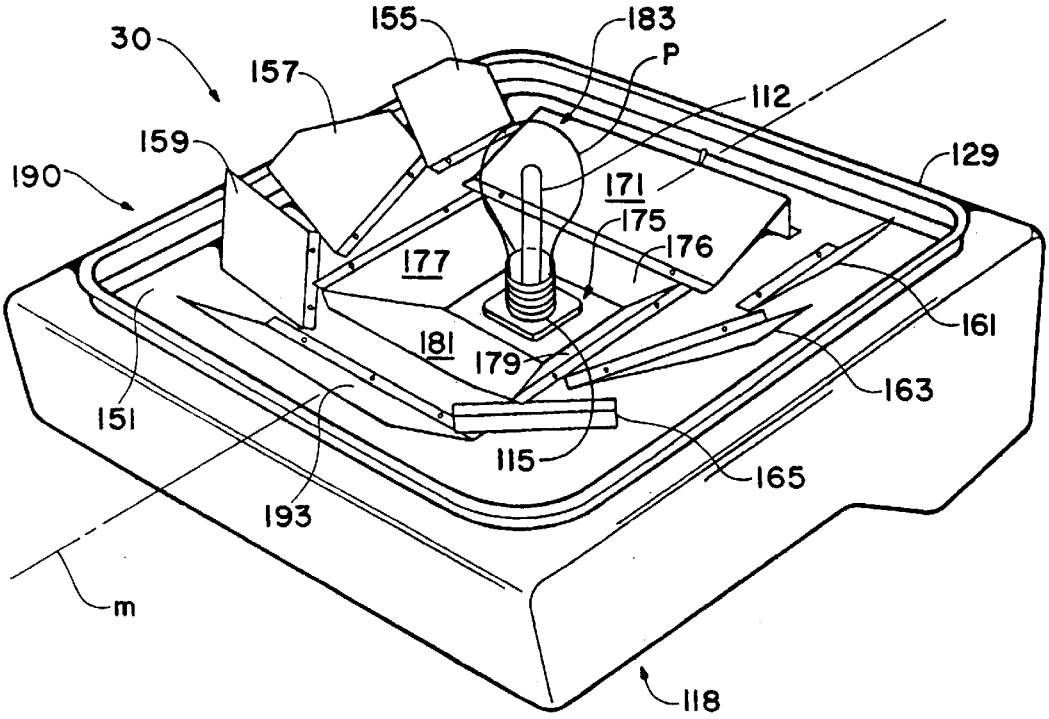
FIG. 10 is a perspective view of a third embodiment of the light fixture of the present invention.

Referring now to FIG. 10, there is shown another light fixture 30 that is constructed according to the present invention. The fixture 30 includes a lens and a cover assembly, not shown, that are identical in structure and function to the assembly 23 and lens 25 shown in FIG. 1. It will be noted that the light fixture 30 is identical in other respects to the fixture 10, having for example, a similar base 118, a plate 151 and a gasket 129 disposed on the plate 151. A reflector assembly 190, comprised of spectral surfaces including a reflective well 175 and sidewalls 177, 181, 179 and 176 project upwardly from a reflective bottom surface 175. Reflective fins 155, 157,159, 161, 163 and 165 are arrayed around the well 175 and panels 171 and 193 are disposed at the front and rear, respectively, of the well 175. It will be noted that the fixture 30, as described thus far, is identical to the fixture 10 disclosed in above referenced U.S. Pat. No. 6,168,295.

The light fixture 30 is novel in that it includes the fixture includes an induction system 110 that is similar in structure and function to the induction system of the light fixture 20. That is, the system 110 includes a discharge vessel or lamp P which contains a mixture of mercury vapor and inert gas. Discharge in the lamp P is initiated by a high electric field and maintained by means of an alternating magnetic (induction) field. Both are generated by an antenna or induction coil 112, located in the center of the discharge vessel p. A power coupler 121, (not shown) electrically coupled via a cable 118 (not shown), to a HF generator 121, serves to transfer energy from the HF generator 121 to the induction coil 112.

As in the case of the prior embodiment, while the base 18 is generally rectangular in shape, other shaped bases are within the scope of the present invention. Although the shape of the base might change from one embodiment to another, the light fixture 10 may be regarded as being generally symmetrical about a line m which, as shown in FIG. 4, divides, or bisects, the light fixture 10 into symmetrical halves. As the term is used herein, "bisects" means "to divide into two generally equal halves".

Figure 11:
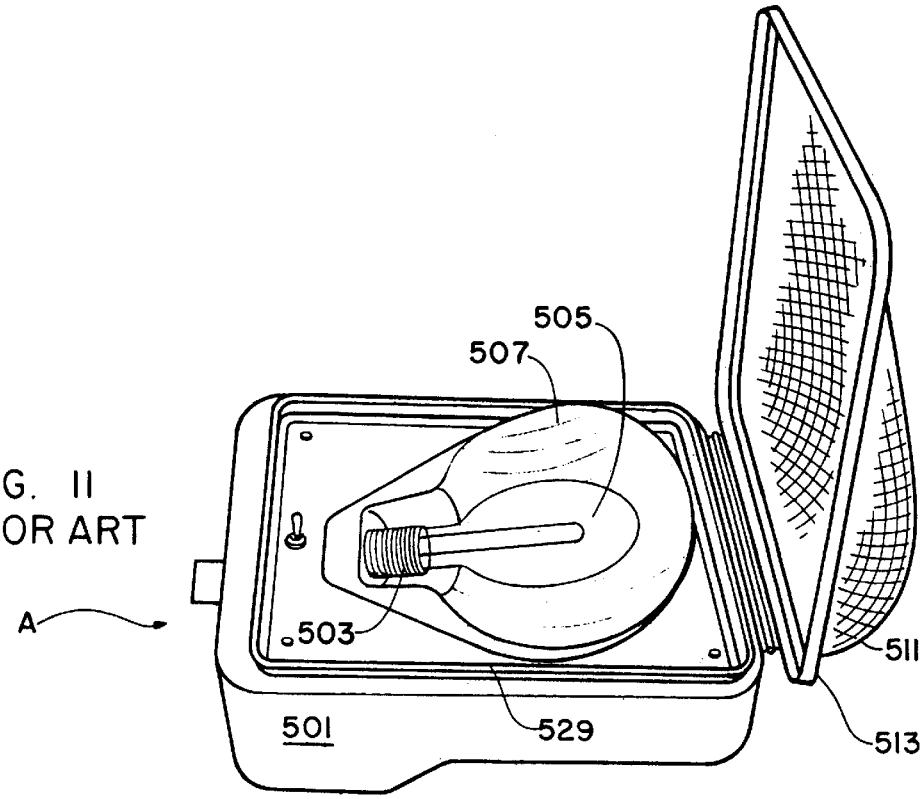
FIG. 11 PRIOR ART
FIG. 11 is a perspective view of a prior art light fixture.

Referring now to FIG. 11, there is shown a prior art light fixture A that is used for illuminating highway signage and billboards. The fixture A includes a base 501 and a hingedly attached cover assembly 513. The base 501 supports a socket 503 that receives a lamp 505. Typically, the fixture A includes a gasket 529, similar in structure and function to the gasket 29 of the light fixture 10. The lamp 505 is backed by a clamshell reflector 507. Since many conventional outdoor light fixtures do not possess a capability for acceptable and uniform light distribution, the cover assembly 513 includes a prismatic lens 511 to aid in light distribution.

Figure 13:
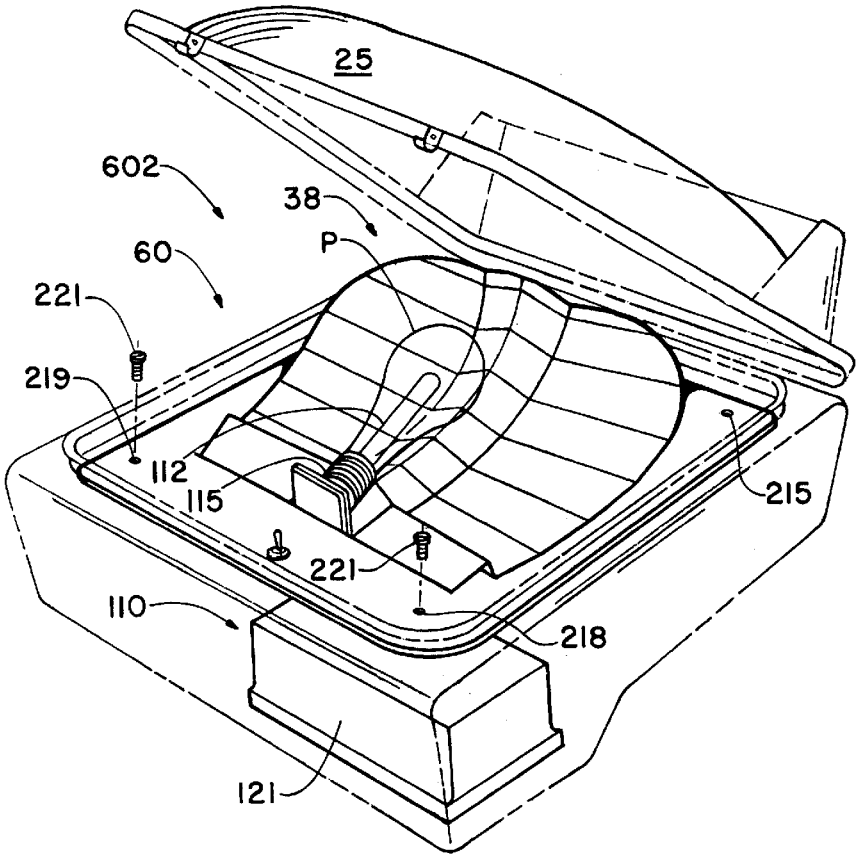
FIG. 13 is a perspective view of a kit for retrofitting the prior art fixture of FIG. 11, utilizing the reflector assembly of FIG. 1 and the induction lighting system shown in FIGS. 8 and 9.
Figure 12:
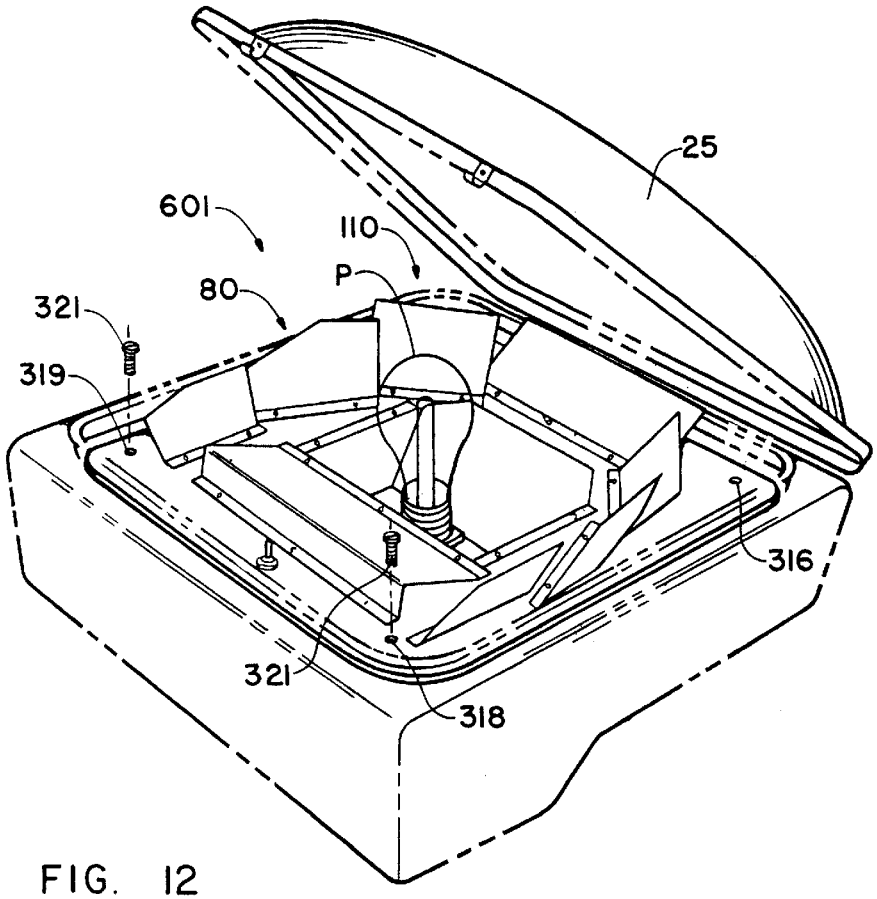
FIG. 12 is a perspective view of a kit for retrofitting the prior art light fixture of FIG. 11, utilizing the reflector assembly shown in 10 and the induction lighting system shown in FIGS, 8 and 9.

With reference now to FIGS. 12 and 13, there are shown, respectively, retrofit kits 601 and 602 which are designed to be utilized with prior art light fixtures, such as the fixture A (FIG. 11) to upgrade the conventional fixture to the standards of the present invention. In each figure, the prior art portions of the respective fixtures, remaining after the retrofit, are shown in dashed lines.

With reference now to FIG. 12, the retrofit kit 601 comprises a light reflector assembly 80 that is identical to the assembly 190 of FIG. 10, an induction lighting assembly 110 identical to that shown in FIG. 8, and fasteners, such as the screws 321 for securing the kit 601 through openings 318 and 319 to underlying structure (not shown). Because of the efficiency of the reflector assembly 80, in cooperation with the induction lighting assembly 110, the prior art prismatic lens can now be replaced with a clear, convex lens 25.

In a similar manner, the kit 602 is attachable to the prior art base, (shown in dashed lines) by fasteners 22 through openings such as 215, 218 and 219, to fix the kit 602 to underlying structure (not shown). The kit 602 includes the reflector assembly 38, described with reference to the light fixture 10 and shown, for example, in FIGS. 1–4, and the induction lighting assembly 110, as described previously. As in the case of the kit 601, because of the efficiency of the reflector assembly 60, in cooperation with the induction lighting assembly 110, the prior art prismatic lens can now be replaced with a clear, convex lens 25.

The present invention may be embodied in other specific forms without departing from its spirit or essential characteristics. The described embodiments are to be considered in all respects only as illustrative and not restrictive. The scope of the invention is, therefore, determined by the appended claims rather than by the foregoing description. All changes, which come within the meaning and range of equivalency of the claims, are to be embraced within their scope.

What is claimed is:

1. A light fixture, comprising:

a reflector for receiving and supporting light generating means, said reflector including a base support skirt having an upper and a lower surface; and a reflective baffle having a plurality of groups of reflective surfaces, wherein said plurality of reflective surfaces includes at least a plurality of intermediate groups of reflective surfaces disposed partially above said base support skirt and partially below said base support skirt.

2. The light fixture according to claim 1, wherein said plurality of reflective surfaces includes at least a plurality of lower groups of reflective surfaces wherein each lower group of reflective surfaces is disposed below said support skirt for further facilitating illuminating a surface with a plurality of substantially rectangularly shaped luminance patterns, each pattern being substantially coterminal with the boundaries of the surface being illuminated.

3. The light fixture according to claim 1, wherein said plurality of reflective surfaces includes at least a plurality of upper groups of reflective surfaces disposed above said support skirt for further facilitating illuminating a surface with a plurality of substantially rectangularly shaped luminance patterns, each pattern being substantially coterminal with the boundaries of the surface being illuminated.

4. The light fixture according to claim 1, wherein said plurality of substantially rectangularly shaped luminance patterns are concentrically disposed.

5. The light fixture according to claim 3, wherein said plurality of the intermediate group of reflective surfaces, said plurality of the lower group of reflective surfaces and said plurality of the upper group of reflective surfaces each includes at least one group of centrally disposed reflective surfaces arranged in an inverted V-shaped configuration.

6. The light fire according to claim 1, including a plurality of integrally connected spectral segments.

7. The light fixture according to claim 1, including an induction lighting assembly.

8. The light fixture according to claim 7, wherein said plurality of groups of reflective surfaces includes a plurality of spectral segments having at least a plurality of lower groups of reflective surfaces wherein each lower group of reflective surfaces is disposed below said base support skirt for facilitating illuminating a surface with a plurality of substantially rectangularly shaped luminance patterns, each pattern being substantially coterminal with the boundaries of the surface being illuminated.

9. The light fixture according to claim 8, wherein said plurality of spectral segments further includes at least a plurality of upper groups of reflective surfaces disposed above said base support skirt for further facilitating illumi nating said surface with a plurality of substantially rectangularly shaped luminance patters, each pattern being substantially coterminal with the boundaries of the surface being illuminated.

10. The light fixture according to claim 9, wherein said plurality of spectral segments further includes at least one group of centrally disposed reflective surfaces arranged in an inverted V-shaped configuration.

11. A kit for retrofitting a conventional light fixture wherein the light fixture includes a base and electrical coupling means, the kit comprising:

a base support skirt;

a reflector baffle having a plurality of integrally connected spectral segments wherein said plurality of segments includes at least a plurality of intermediate reflective surfaces disposed partially above said base support skirt and partially below said base support skirt;

an induction lighting assembly; and means for attaching said reflector assembly to said base and means for connecting said reflector assembly to said base and means for connecting said induction lighting assembly to said electrical coupling means.

12. The light according to claim 11, wherein said at least a plurality of intermediate reflective surfaces includes at least one group of centrally disposed reflective surfaces arranged in an inverted V-shaped configuration.

* * * * *